US010689921B1

(12) United States Patent
Murphy

(10) Patent No.: US 10,689,921 B1
(45) Date of Patent: Jun. 23, 2020

(54) ONE-PIECE PRODUCTION/ANNULUS BORE STAB WITH INTEGRAL FLOW PATHS

(71) Applicant: FMC Technologies, Inc., Houston, TX (US)

(72) Inventor: Richard Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/267,960

(22) Filed: Feb. 5, 2019

(51) Int. Cl.
*E21B 17/18* (2006.01)
*E21B 33/04* (2006.01)

(52) U.S. Cl.
CPC ..... *E21B 17/18* (2013.01); *E21B 33/04* (2013.01)

(58) Field of Classification Search
CPC ..... E21B 17/18; E21B 33/04
See application file for complete search history.

(56) References Cited

U.S. PATENT DOCUMENTS 4,836,305 A * 6/1989 Curlett ..... E21B 17/003 175/215
5,217,071 A * 6/1993 Ferry ..... E21B 17/18 166/242.3
6,464,261 B1 * 10/2002 Dybevik ..... E21B 17/042 285/123.15
6,491,097 B1 * 12/2002 Oneal ..... E21B 17/1085 166/169
6,634,427 B1 * 10/2003 Turner ..... E21B 17/028 166/242.3
7,063,160 B2 * 6/2006 Fenton ..... E21B 33/035 166/368
7,604,047 B2 10/2009 Broussard
8,286,713 B2 * 10/2012 Broussard ..... E21B 23/01 166/338
10,145,206 B2 * 12/2018 Williamson ..... E21B 34/14
10,316,594 B2 * 6/2019 Shearer ..... E21B 17/1078
10,393,302 B2 * 8/2019 Dill ..... F16L 9/18
2016/0138355 A1 * 5/2016 Rytlewski ..... E21B 33/0355 166/336
2018/0179847 A1 * 6/2018 Derryberry ..... E21B 33/0355

FOREIGN PATENT DOCUMENTS

GB 2196410 A * 4/1988 ..... E21B 17/025

* cited by examiner

*Primary Examiner* — Matthew R Buck
(74) *Attorney, Agent, or Firm* — Amerson Law Firm, PLLC

(57) ABSTRACT

One illustrative production/annulus bore stab disclosed herein includes a one-piece body that comprises a first cylindrical outer surface and a second cylindrical outer surface and a plurality of individual fluid flow paths defined entirely within the one-piece body. In this illustrative example, each of the individual fluid flow paths is fluidly isolated from one another and each of the fluid flow paths comprise a first inlet/outlet at a first end of the fluid flow path that is positioned in the first cylindrical outer surface and a second inlet/outlet at a second end of the fluid flow path that is positioned in the second cylindrical outer surface.

17 Claims, 14 Drawing Sheets

ONE-PIECE PRODUCTION/ANNULUS BORE STAB WITH INTEGRAL FLOW PATHS

TECHNICAL FIELD

The present disclosed subject matter generally relates to various embodiments of a one-piece production/annulus bore stab with integral flow paths.

BACKGROUND

A typical wellhead structure for an oil and gas well includes a high-pressure wellhead housing secured to a low-pressure housing, such as a conductor casing. The wellhead structure supports various casing strings that extend into the well. One or more casing hangers are typically landed in the high-pressure wellhead housing, with each casing hanger being located at the upper end of a string of casing that extends into the well. A tubing hanger is also typically landed in the wellhead or a tubing head. A string of production tubing is supported by the tubing hanger. The production tubing extends through the production casing and provides a path for conveying production fluids from the formation to the wellhead. The area between the production tubing and the production casing is referred to as the annulus.

An oil/gas well also typically includes a production tree (also referred to as a Christmas tree) that is mounted on the high-pressure housing. The production tree includes a main production bore. Production bore stabs are commonly positioned between the main production bore of a production tree and the production bore of the tubing hanger so as to provide a flow passageway between those two production bores. This arrangement permits the production bore of the production tree and the production bore of the tubing hanger to be fluidly isolated from other bores and passageways within the completion system.

FIGS. 1-4 depict various aspects of one illustrative example of a prior art two-piece production/annulus bore stab 10. FIG. 2 is a cross-sectional view of the prior art production/annulus bore stab 10 taken through the axial length of the production/annulus bore stab 10. FIGS. 3 and 4 are transverse cross-sectional views of the production/annulus bore stab 10 taken where indicated in FIG. 1. As shown in these drawings, the prior art production/annulus bore stab 10 generally comprises an inner production stab body 11, an outer annulus stab body 12, an annulus T-ring 13, an annulus metal seal 14 and an annulus seal retainer 15. The production/annulus bore stab 10 also comprises a secondary annulus spacer 16, a secondary metal seal 17, a spacer 18, a primary metal seal 19 and a primary seal retainer 20. Also depicted is a set screw 21, a lower head cap screw 22, a set screw 23, a plurality of upper flow openings 24, a plurality of lower flow openings 25 and a plurality of flow channels 26. In general, the set screw 21 secures the annulus seal retainer 15 in position with respect to the outer annulus stab body 12 so as to secure the secondary metal seal 17 in position. The primary seal retainer 20 is adapted to be threadingly coupled to the inner production stab body 11 to retain the primary metal seal 19 in position and thereby provide a seal between an end 12A of the outer annulus stab body 12 and the outer surface 11A of the inner production stab body 11.

As shown in FIGS. 3 and 4, the outer surface 11A of the inner production stab body 11 has a plurality of channels or recesses 26 formed therein. When the inner production stab body 11 is positioned within the outer annulus body 12, a plurality of individual fluid flow paths 27 are defined between the recesses 26 and the inner surface 12B of the outer annulus stab body 12. Each of these fluid flow paths 27 is in fluid communication with one of the upper openings 24 and one of the lower openings 25.

The present application is directed to various embodiments of an improved one-piece production bore stab with integral flow paths.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to various embodiments of a one-piece production/annulus bore stab with integral flow paths. One illustrative production/annulus bore stab disclosed herein comprises a one-piece body that comprises a first cylindrical outer surface and a second cylindrical outer surface and a plurality of individual fluid flow paths defined entirely within the one-piece body. In this illustrative example, each of the individual fluid flow paths is fluidly isolated from one another with the body and each of the fluid flow paths comprise a first inlet/outlet at a first end of the fluid flow path that is positioned in the first cylindrical outer surface and a second inlet/outlet at a second end of the fluid flow path that is positioned in the second cylindrical outer surface.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein:

FIGS. 13-16 depict various aspects of yet another embodiment of a production/annulus bore stab with integral flow paths disclosed herein.

Figure 1:
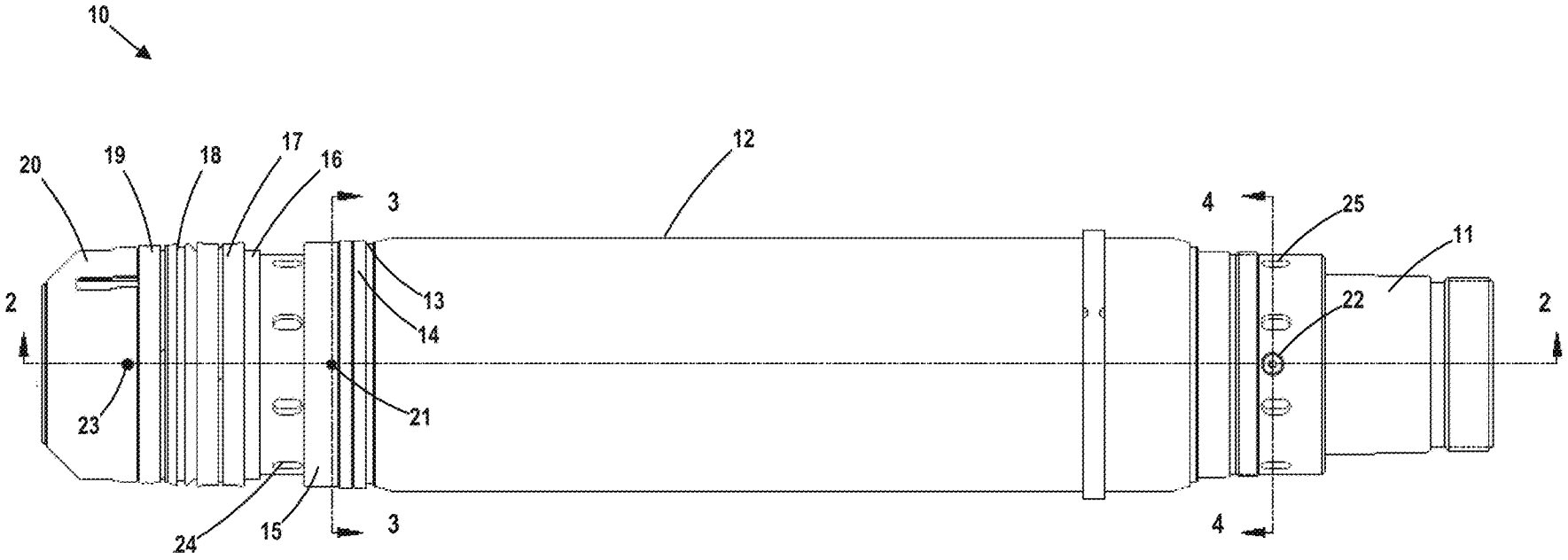
Fig. 1 (Prior Art)
FIGS. 1-4 depict various aspects of a prior art production/annulus bore stab.
Figure 2:
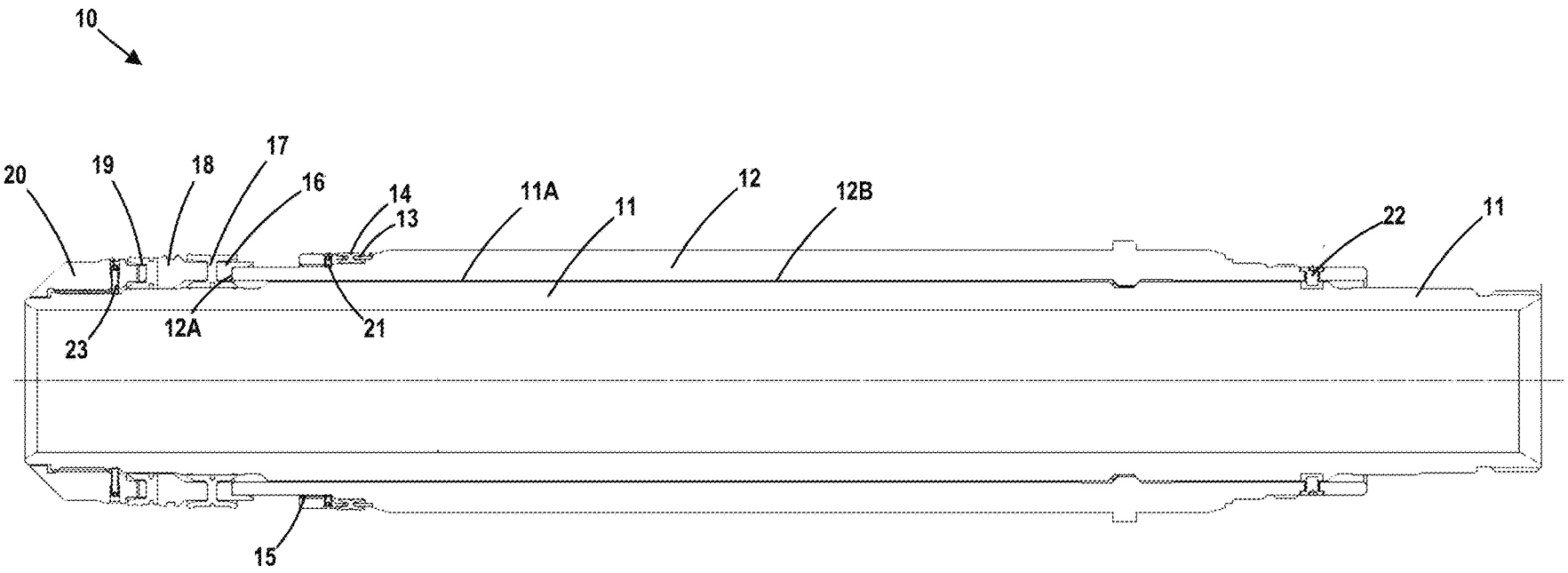
Fig. 2 (Prior Art)
Figure 4:
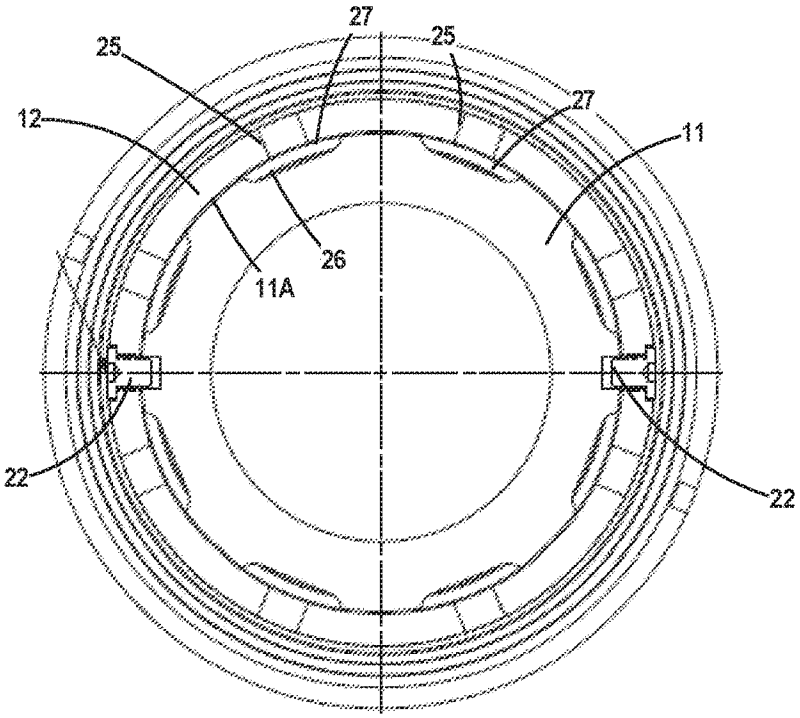
Fig. 4 (Prior Art)
Figure 3:
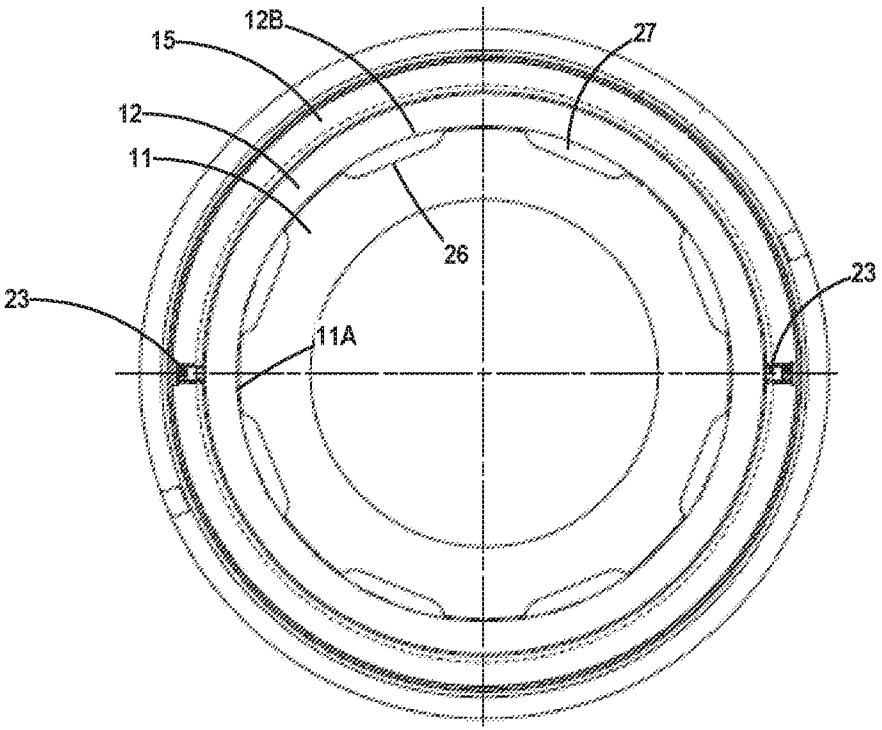
Fig. 3 (Prior Art)

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 5:
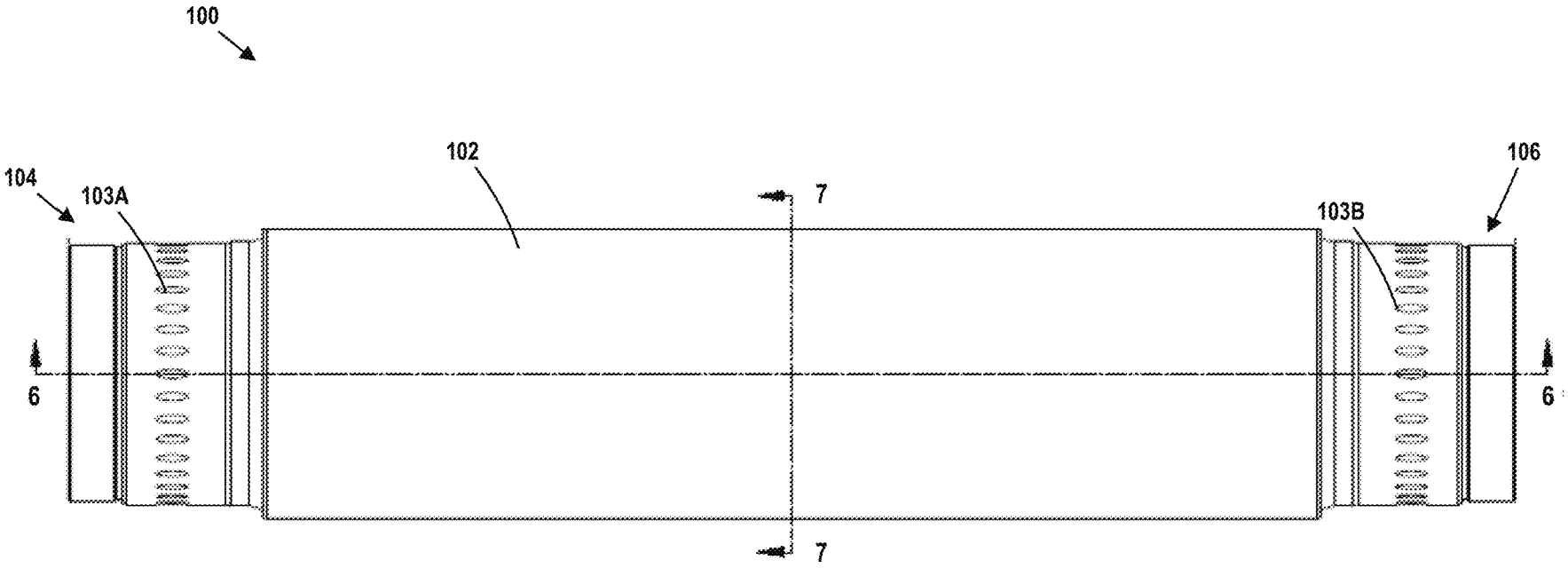
FIGS. 5-12 depict various aspects of various embodiments of a one-piece production/annulus bore stab with integral flow paths.
Figure 6:
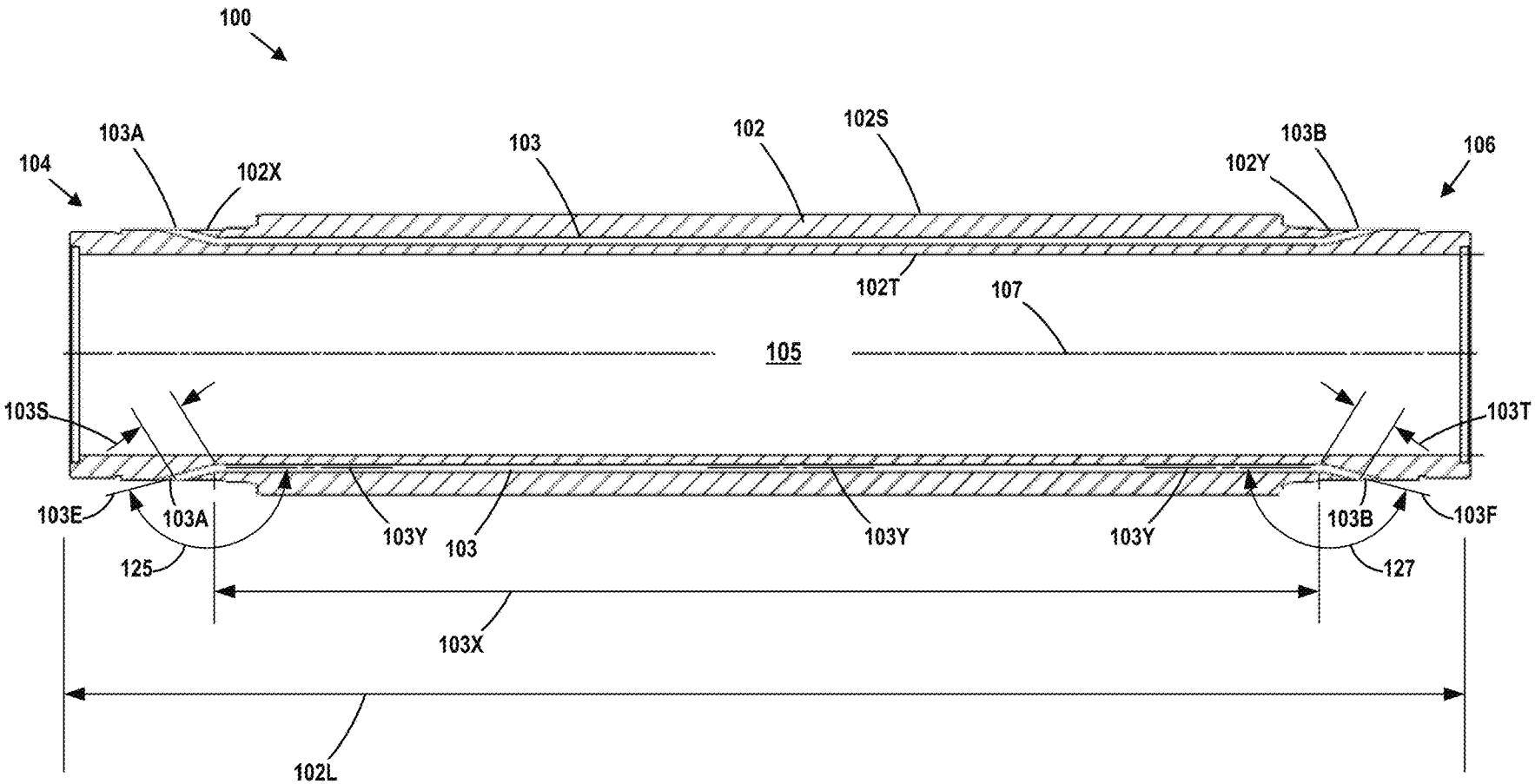
Figure 7:
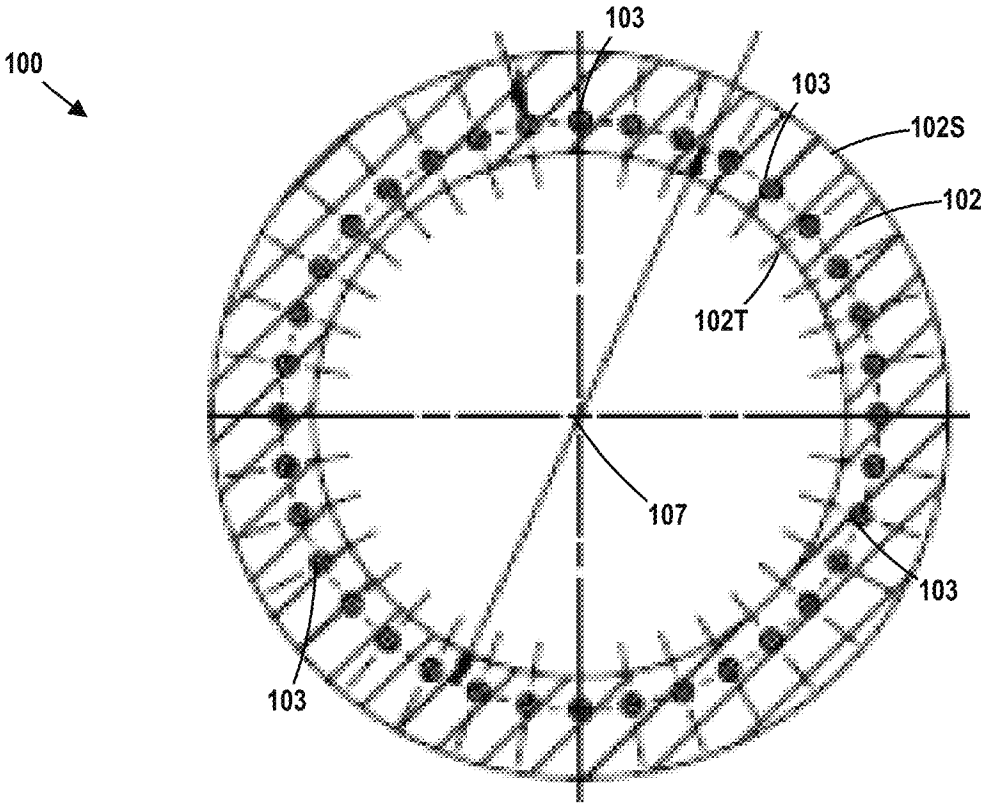
Figure 8:
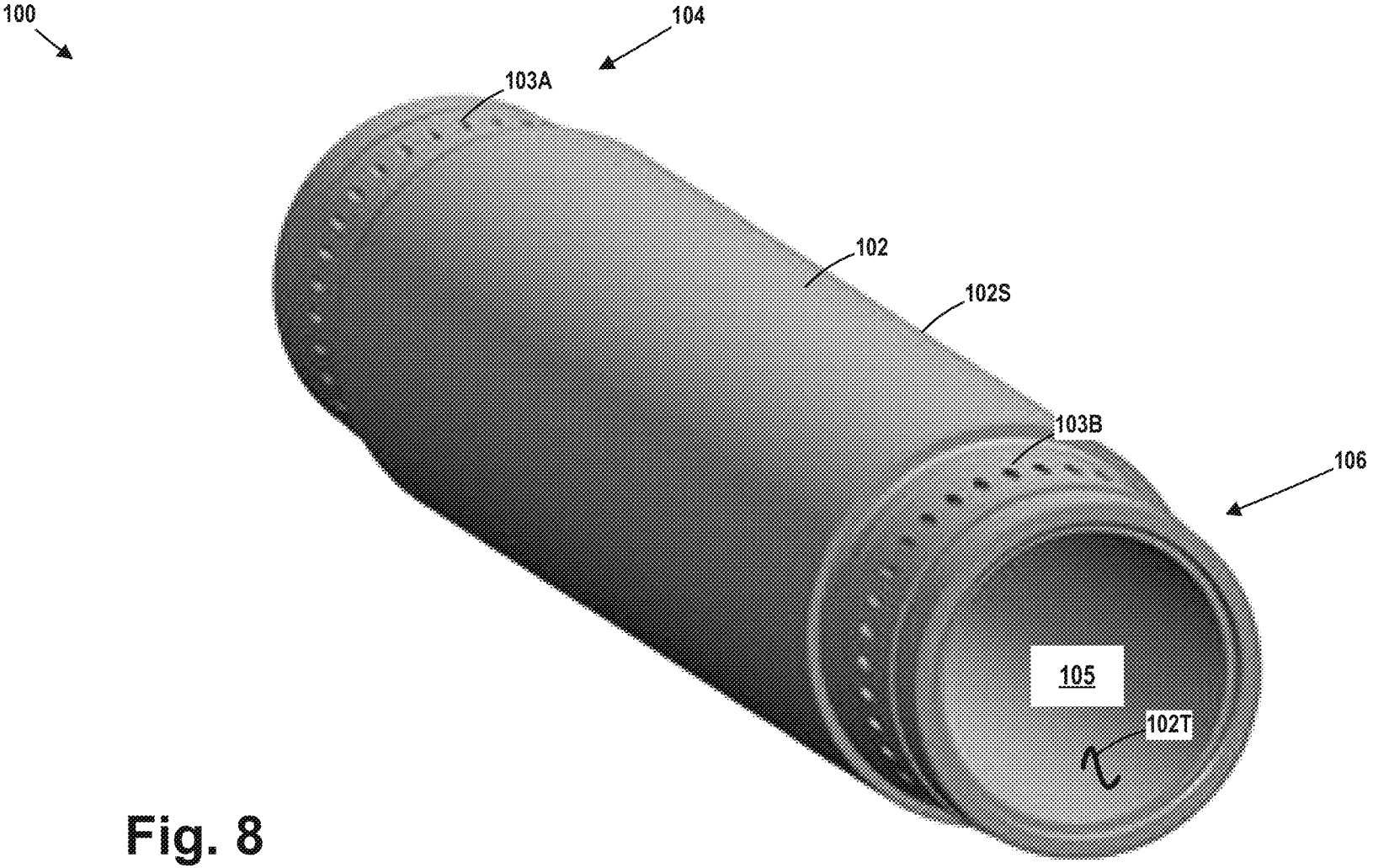
Figure 9:
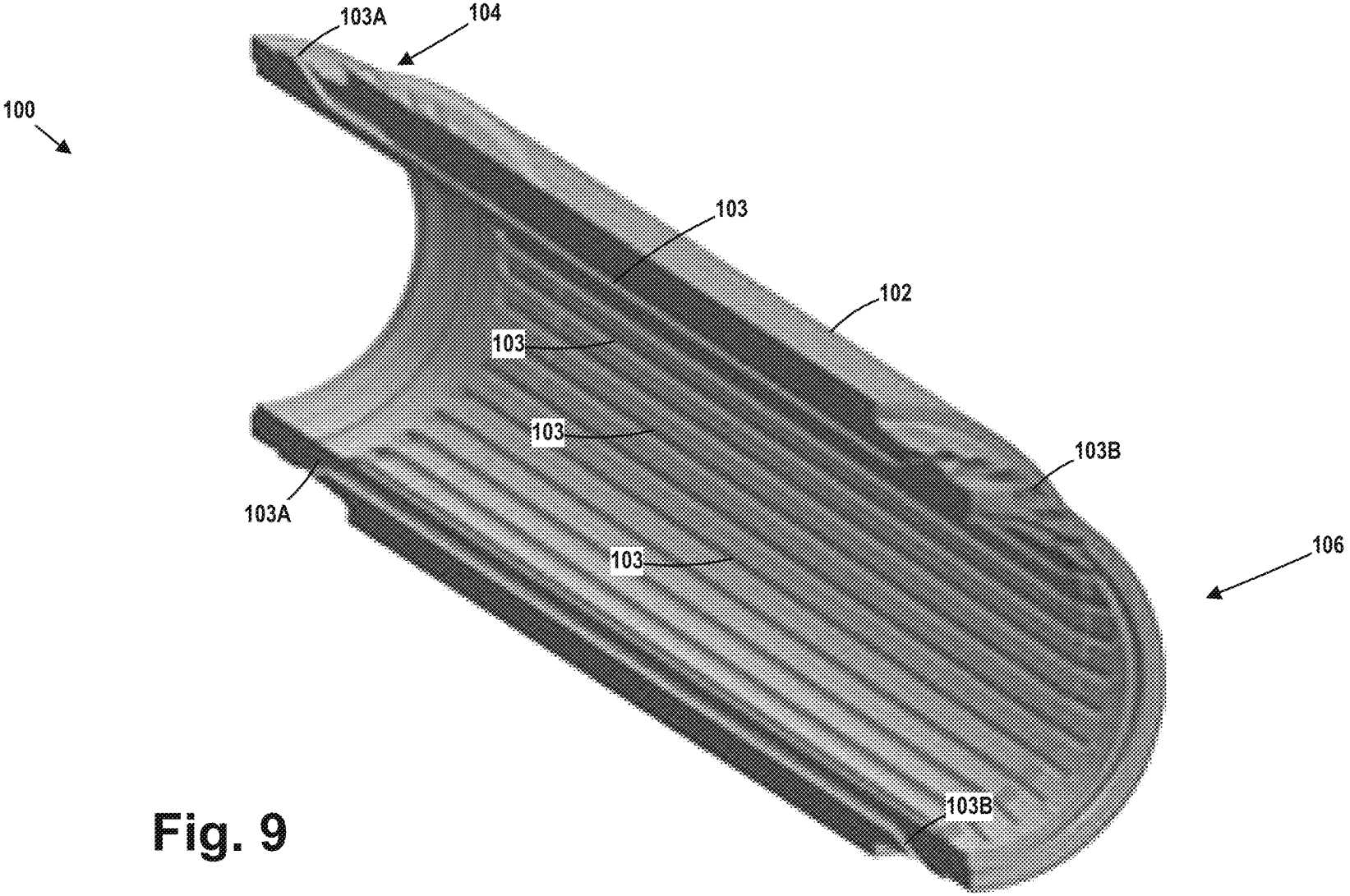

FIGS. 5-12 depict various aspects of various embodiments of a one-piece production/annulus bore stab 100 with integral flow paths. FIG. 5 is a side view of one illustrative embodiment of a one-piece production/annulus bore stab 100 disclosed herein. FIG. 6 is a cross-sectional view of the illustrative one-piece production/annulus bore stab 100 taken through the axial length of the production/annulus bore stab 100. FIG. 7 is a transverse cross-sectional view of the production/annulus bore stab 100 taken where indicated in FIG. 5. FIG. 8 is a perspective view of the depicted example of a one-piece production/annulus bore stab 100. FIG. 9 is a cross-sectional perspective view of the one-piece production/annulus bore stab 100 taken through the axial length of the production bore stab 100.

In general, one illustrative embodiment of a novel production/annulus bore stab 100 disclosed herein comprises a unitary, one-piece body 102 with a first end 104 and a second end 106. The body 102 has an outermost cylindrical surface 102S and an inner cylindrical surface 102T. Also depicted in FIG. 6 are a central bore 105 and an axial centerline 107 of the one-piece production/annulus bore stab 100. The physical dimensions of the one-piece body 102, e.g., the axial length 102L, outside diameters, the inside diameter of the one-piece production/annulus bore stab 100, as well as the radial thickness of the body 102 at various locations along the axial length 102L, may vary depending upon the particular application.

A plurality of individual and separate flow paths 103 are formed within the body 102. Each of the flow paths 103 has a first inlet/outlet 103A positioned at a first end (adjacent end 104) of the flow path 103 and a second inlet/outlet 103B that is positioned at a second end (adjacent end 106) of the fluid flow path 103. The first inlet/outlets 103A are positioned in or extend through a first cylindrical outer surface 102X of the one-piece body 102, while the second inlet/outlets 103B are positioned in or extend through a second cylindrical outer surface 102Y of the one-piece body 102. The outside diameters of the first and second cylindrical outer surfaces 102X, 102Y, respectively, may be the same or they may be different from one another. As indicated, in one illustrative example, each of the plurality of individual fluid flow paths 103 are formed or defined entirely within the one-piece body 102. Moreover, in one illustrative embodiment, each of the individual fluid flow paths 103 are fluidly isolated from one another within the one-piece body 102. As depicted, in one illustrative embodiment, each of the plurality of individual flow paths 103 extends for substantially the entire axial length 102L of the one-piece body 102.

The routing and configuration of the individual flow paths 103 within the one-piece body 102 may vary depending upon the particular application. In one particularly illustrative example, each of the plurality of individual flow paths 103 may comprise an axial length portion 103X having a centerline 103Y that is substantially parallel to the longitudinal centerline 107. In other applications, all or part of the one or more of the flow paths 103 may be oriented in a non-parallel relationship with respect to the longitudinal centerline 107. For example, at least portions of the flow paths 103 may be curved or otherwise non-linear with respect to the centerline 107 (or some other reference). Thus, the configuration or positioning of portions of the flow paths 103 with respect to the longitudinal centerline 107 (or some other reference) may vary depending upon the particular application.

With continuing reference to FIG. 6, in this particular example, each of the fluid flow paths 103 comprises a first flow path transition region 103S between the axial length portion 103X and the first inlet/outlet 103A, and a second flow path transition region 103T between the axial length portion 103X and the second inlet/outlet 103B. As also depicted, a line 103E extending through a center of the first inlet/outlet 103A and intersecting the flow path centerline 103Y at a first end of the axial length portion 103X defines a first included angle 125 that is an obtuse angle. Similarly, a line 103F extending through a center of the second inlet/outlet 103B and intersecting the flow path centerline 103Y at a second end of the axial length portion 103X defines a second included angle 127 that is an obtuse angle. In some applications, the angles 125, 127 may be approximately the same. In other applications, the angles 125, 127 may be different from one another. Additionally, the size, i.e., diameter of the flow paths 103 as well as the number of flow paths 103 may vary depending upon the particular application. With reference to FIG. 7, the illustrative one-piece production/annulus bore stab 100 disclosed herein comprises thirty-six flow paths 103, each of which have a diameter of approximately 6.35 mm (0.25 inches).

Figure 10:
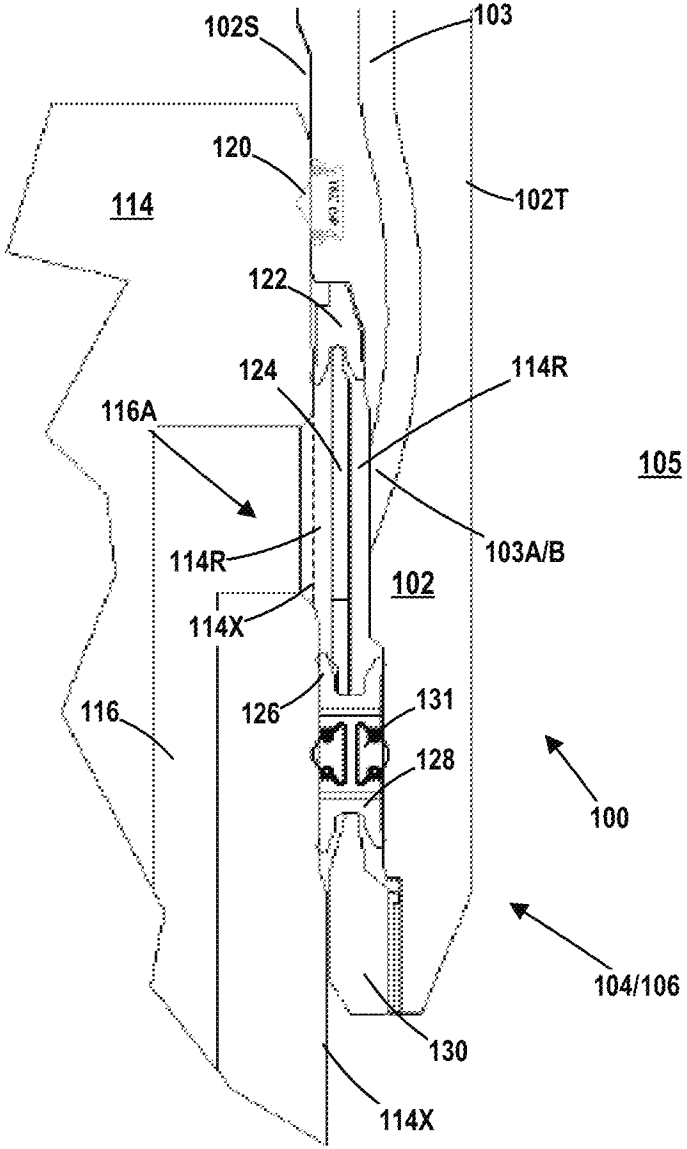

FIG. 10 is a cross-sectional view depicting the engagement and positioning of one end of the one-piece production/annulus bore stab 100 relative to another item of equipment 114, e.g., a tubing hanger or the valve block of a production tree. Also depicted in FIG. 10 is an elastomer seal 120, a seal 122, a seal spacer 124, a seal 126, a seal 128, an elastomer seal 131 and a seal retaining ring 130 that is threadingly coupled to the body 102. All of the illustrative seals and spacers depicted in FIG. 10 may or may not be present in all applications. The equipment 114 comprises at least one annulus fluid flow passageway or path 116 (only one of the annulus fluid flow passageways 116 is shown in FIG. 10). In one illustrative example, each of the one or more annulus fluid flow paths 116 is adapted to be in fluid communication with a radial gallery (or annulus fluid collection chamber) 116A. In some applications, the equipment 114 may contain a plurality of such collection chambers 116A, each of which may be fluidly isolated from one another. In one illustrative example, the annulus fluid collection chamber 116A may be defined (in whole or part) by the outer diameter (102X or 102Y) of the body 102 and the inner diameter 114X of the equipment 114.

In one illustrative example, the annulus fluid collection chamber 116A is adapted to be placed in fluid communication with one or more (and sometimes all) of the annulus fluid flow paths 103 in the body 102. The seal spacer 124 may comprise one or more openings that allow fluid to flow freely between the flow paths 103/the annulus fluid collection chamber 116A and the one or more flow paths 116 in the equipment 114. The illustrative embodiment of the one-piece production/annulus bore stab 100 discussed above may be manufactured using a variety of known manufacturing techniques, e.g., hot isostatic pressing (HIP), 3D printing, etc.

Figure 11:
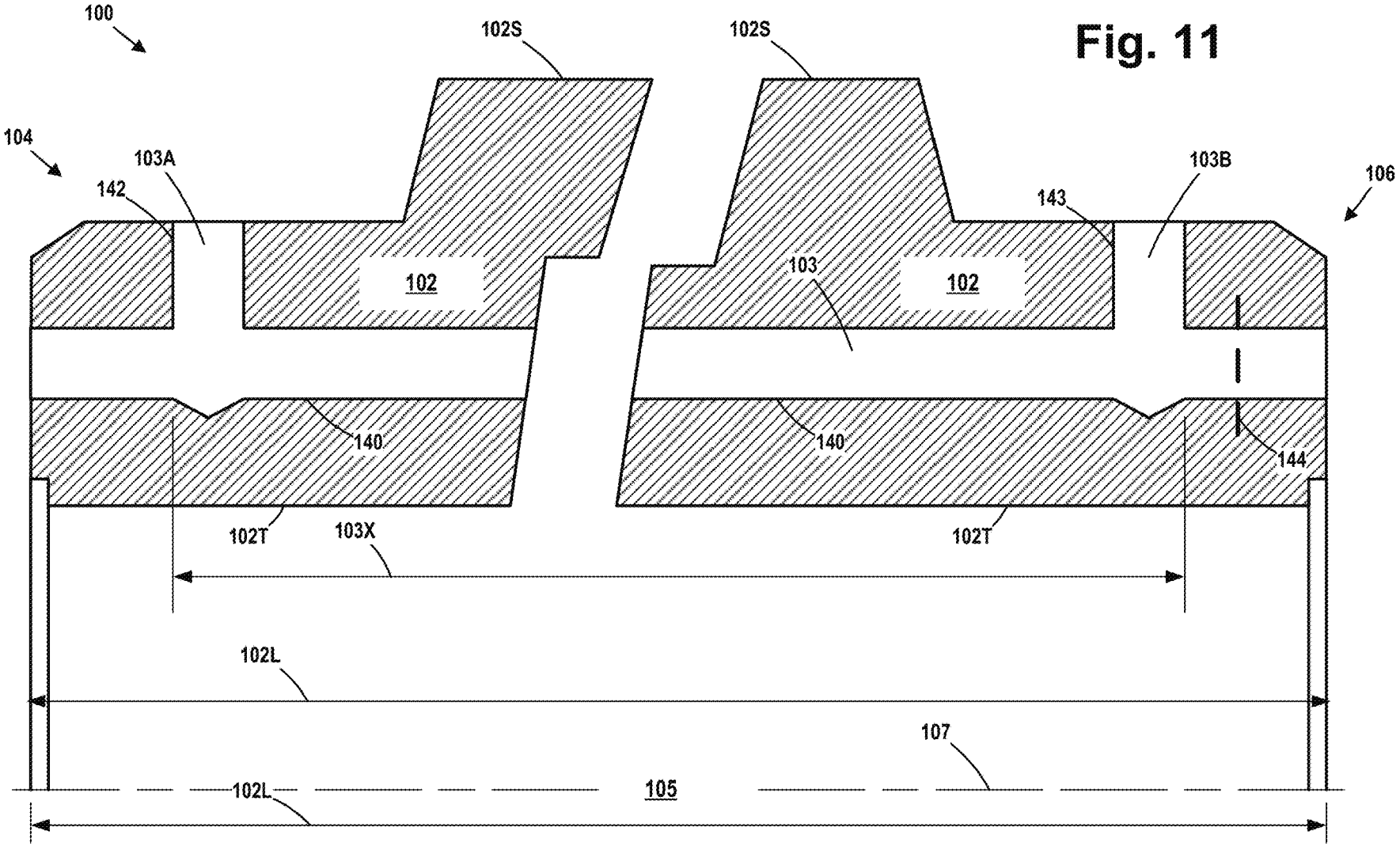
Figure 12:
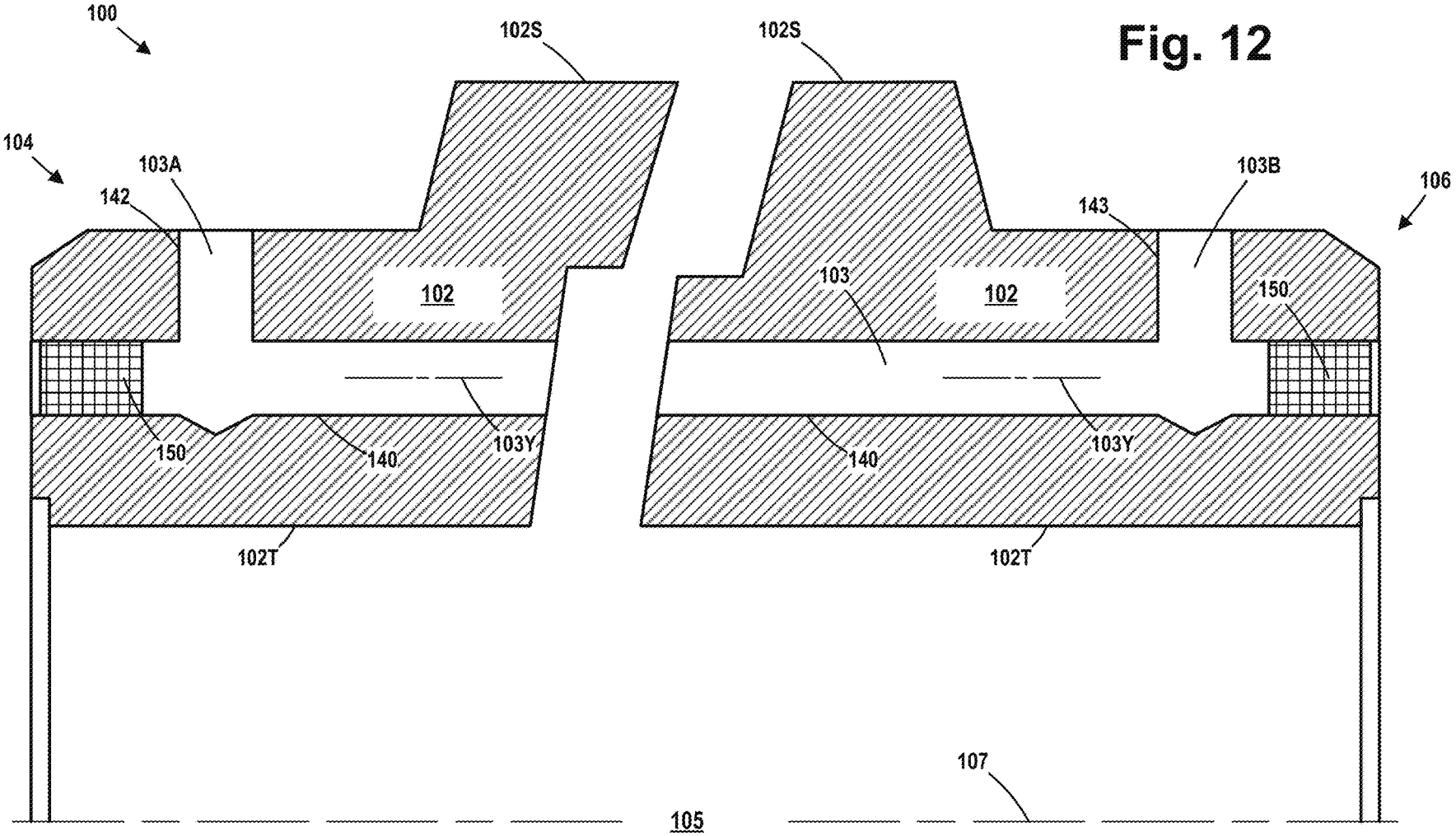

FIGS. 11 and 12 depict an embodiment of the one-piece production/annulus bore stab 100 wherein the individual flow paths 103 in the body 102 are formed by a process that includes drilling a plurality of intersecting bores in the body 102. FIG. 11 depicts the one-piece production/annulus bore stab 100 at a point where a plurality of axial bores 140 (only one of which is shown) have been drilled though the entire axial length 102L of the body 102 to define at least part of the axial length portion 103X of one of the flow paths 103 with a centerline 103Y. In some applications, the axial bores 140 need not extend throughout the entire axial length 102L of the body 102, e.g., the bores 140 may stop within the body at, for example, a location within the body 102 indicated by the dashed line 144 adjacent the end 106. In some applications, the axial bores 140 may be drilled in a single pass, e.g., from the end 104 through the end 106. In other applications, the axial length 102L of the one-piece production bore stab 100 may be such that each of the axial bores 140 is formed by drilling a bore from each of the opposite ends 104, 106 into the body 102 to form one of the flow paths 103, wherein these separate bores are substantially co-linear with one another (or otherwise in fluid communication with one another) and at least partially engage one another within the body 102.

Also depicted in FIG. 11 are first and second radial bores 142, 143 that are drilled to intersect with one of the axial bores 140. As indicated, in one illustrative example, the radial bores 142 and 143, respectively, correspond to the first and second inlet/outlet 103A, 103B of each of the fluid flow paths 103. In the depicted example, the axial bores 140 were formed prior to the formation of the radial bores 142, 143, but the order could be reversed if desired. FIG. 12 depicts the one-piece production bore stab 100 after plugs 150 were secured within the axial openings 140 at opposite ends thereof. The plugs 150 may be secured in position using any of a variety of known techniques, e.g., welding, providing a threaded connection between the plugs 150 and the axial bore 140, etc. Of course, in the example where the axial bores 140 do not extend throughout the entire axial length of the body 102, e.g., the case where they stop at location 144 (see FIG. 11), then only a single plug 150 would be required within each of the axial bores 140. With the plug(s) 150 installed, a plurality of individual flow paths 103 have been formed within the one-piece body 102. More specifically, in this example, each of the plurality of individual flow paths 103 (formed entirely within the body 102) comprises first and second radially-oriented flow paths 142, 143 that are in fluid communication with one of the axial bores 140, wherein the first radially-oriented flow path 142 terminates at the first inlet/outlet 103A and the second radially-oriented flow path 143 terminates at the second inlet/outlet 103B. In this particular example, a centerline of each of the first and second radially-oriented openings 142, 143 is positioned substantially normal to the flow path centerline 103Y of the axial bore 140. In the example shown in FIGS. 11 and 12, the bores 140, 142, 143 were formed by drilling the bores into the body 102. In other applications, such bores may be formed by other manufacturing processes, e.g., laser boring, etc.

As will be appreciated by those skilled in the art after a complete reading of the present application, one illustrative example of a novel one-piece production/annulus bore stab 100 with integral fluid flow paths 103 formed entirely within the one-piece body 102 disclosed herein provides some distinct advantages relative to prior art production bore stabs and annulus bore stabs. One problem associated with the illustrative prior art production/annulus stab body 10 discussed in the background section of this application involved maintaining seal integrity under operational conditions. That is, each of the inner production stab body 11 and the outer annulus stab body 12 are essentially two separate pressure vessels that may experience different thermal loads (e.g., different temperatures) when in service. Such different thermal loads may cause the inner production stab body 11 and the outer annulus stab body 12 to exhibit different amounts of radial and/or axial expansion under certain operating conditions. In turn, such differences in radial and/or axial expansion between the inner production stab 11 and the outer annulus stab 12 can cause problems with respect to maintaining the integrity of the seals, e.g., the primary metal seal 19 and/or the secondary metal seal 17, on the prior art production/annulus stab 10. The novel one-piece production annulus stab 100 may help to eliminate or at least reduce this problem due to its one-piece construction.

Another problem with the prior art production/annulus stab 10 was related to the required radial thickness of the inner production stab body 11 and/or the outer annulus stab body 12. That is, each of the inner production stab body 11 and the outer annulus stab body 12 are essentially two separate pressure vessels that must be designed for the unique loading conditions experienced by each of these separate pressure vessels during operation. More specifically, since there were no lateral seals between the fluid flow paths 27, the exterior surface of the inner production stab body 11 was subjected to an external pressure which tended to compress the inner production stab body 11. The radial thickness of the inner production stab body 11 was increased to resist this external pressure. Additionally, due to the two-piece configuration of the prior art production/annulus bore stab 10, the outer annulus stab body 12 was subjected to an internal pressure (the annulus pressure) at its inner surface due to the presence of the fluid flow paths 27. Thus, the radial thickness of this outer annulus stab body 12 had to be sufficient to accommodate this additional pressure loading. In contrast, the novel one-piece production/annulus bore stab 100 disclosed herein is essentially a single pressure vessel. Of course, that single pressure vessel will also have to be designed and sized for all loading conditions, e.g., internal and external pressures. However, due to the unique one-piece configuration of the production/annulus bore stab 100 disclosed herein, as well as the placement of the individual fluid flow paths 103 within the body 102, the overall radial thickness of the body 102 will typically be less than the combined radial thicknesses of the inner production stab body 11 and the outer annulus stab body 12. Other advantages of the various embodiments of the one-piece production bore stab 100 disclosed herein may be apparent to those skilled in the art after a complete reading of the present application.

Figure 13:
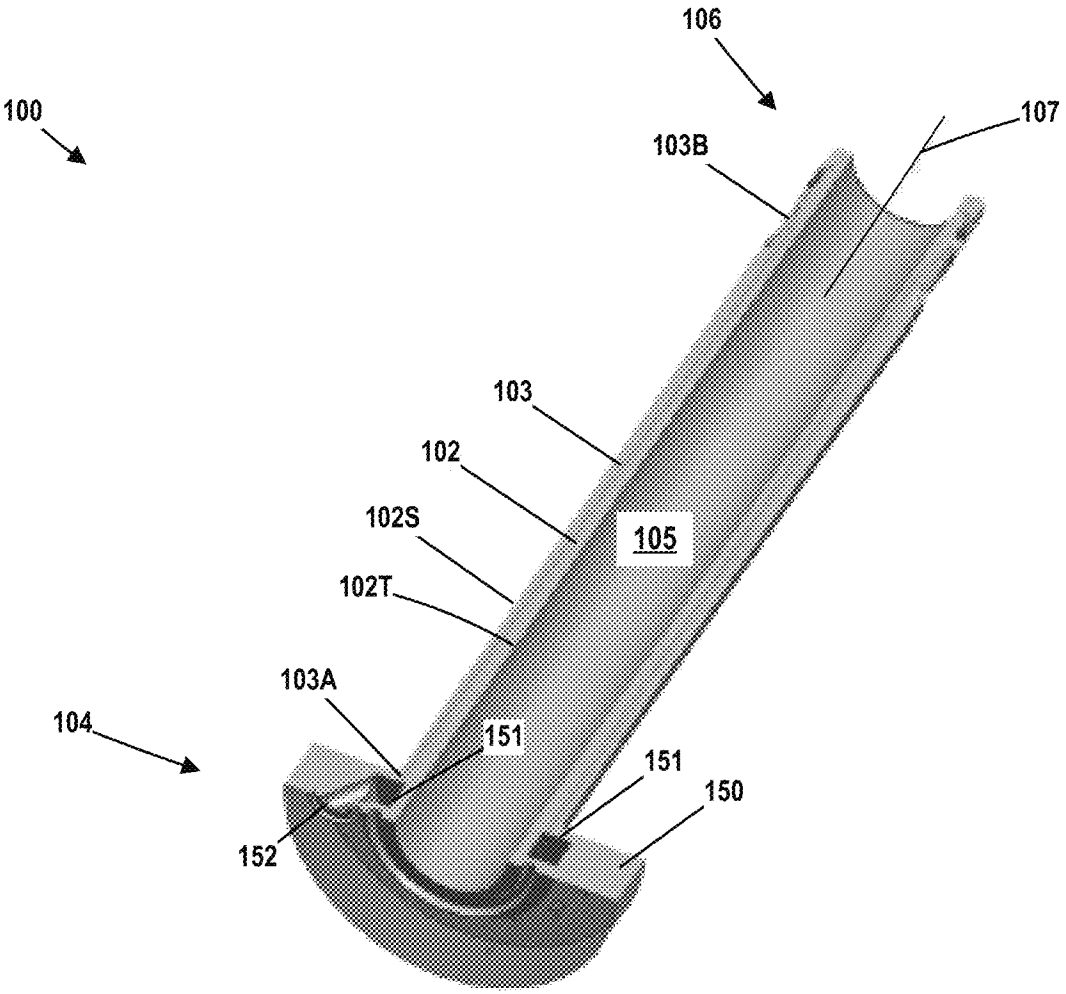
Figure 14:
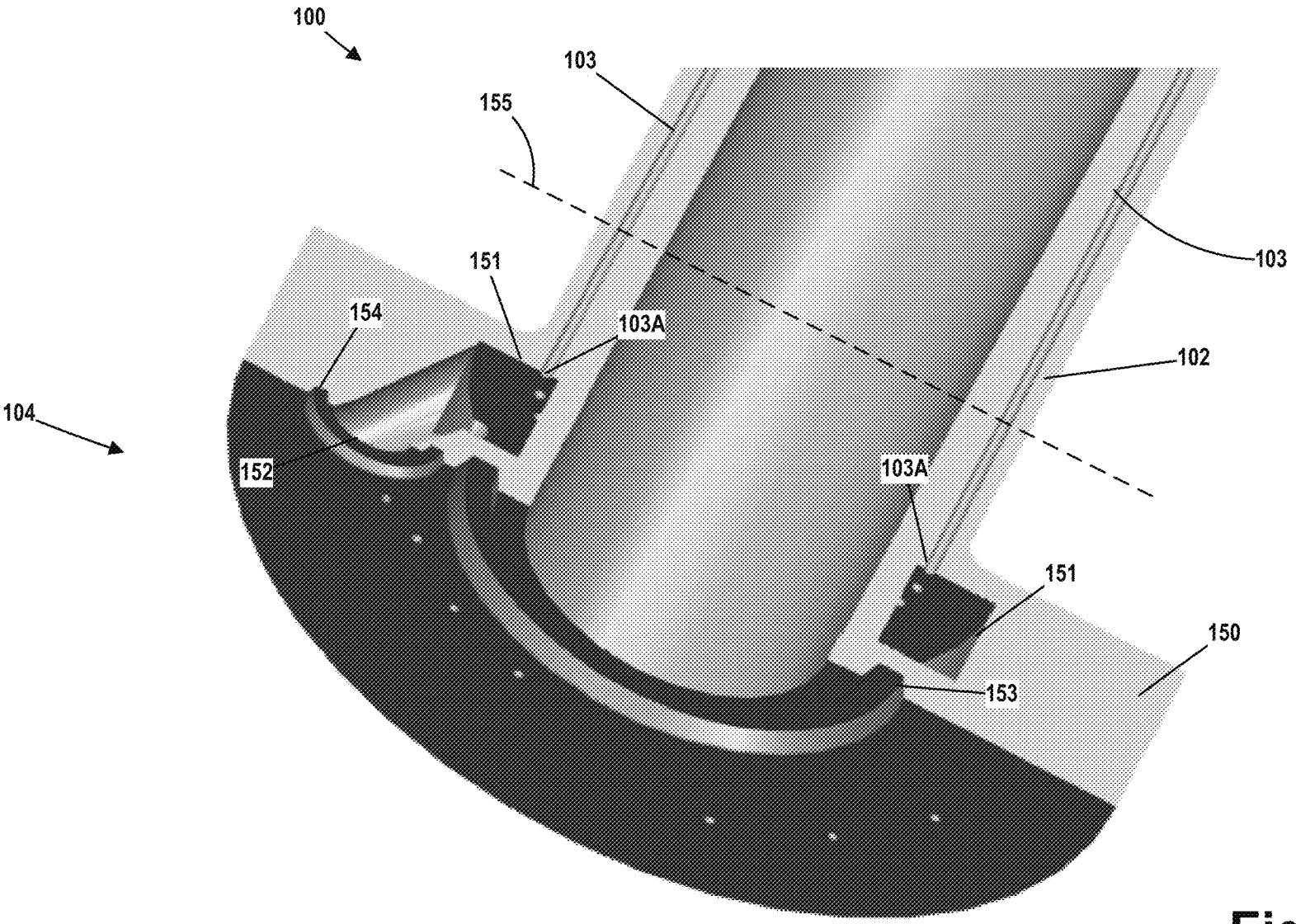
Figure 15:
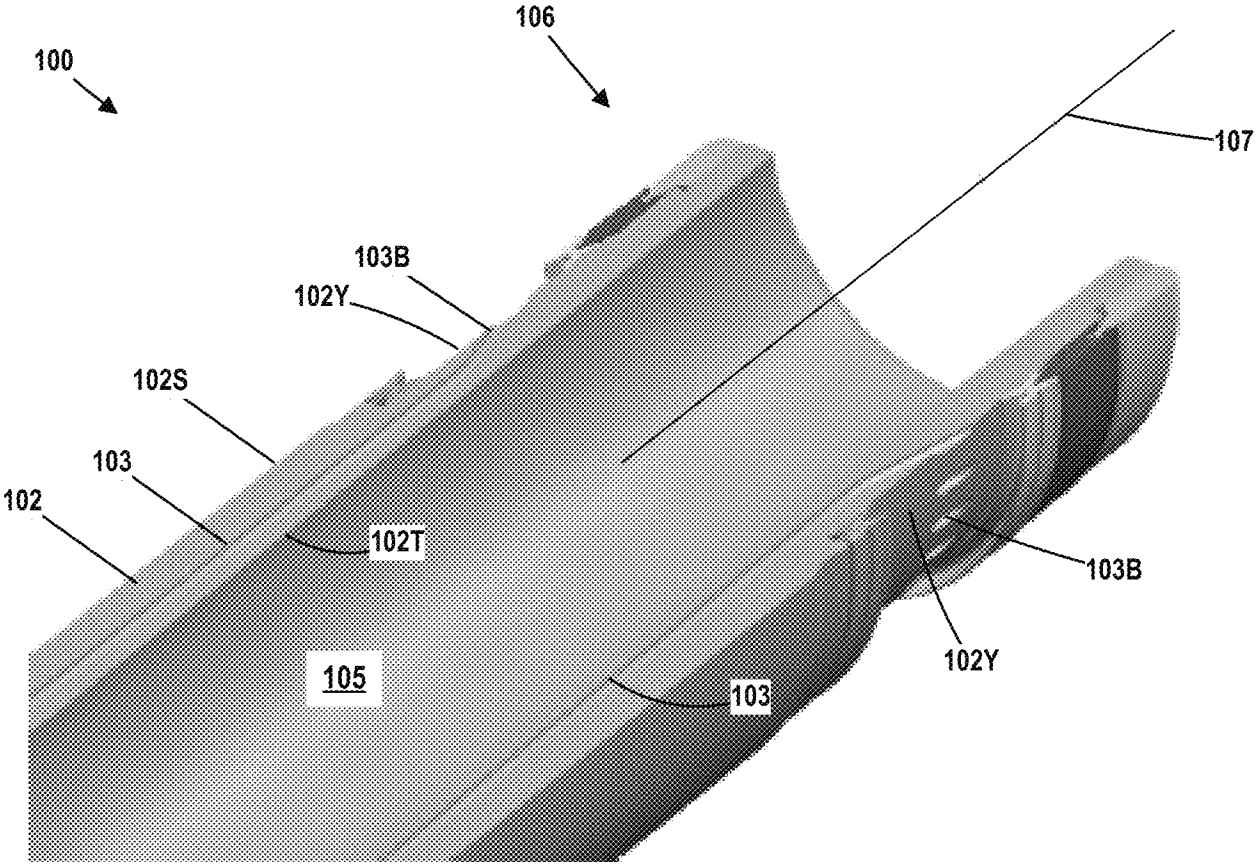

FIGS. 13-16 depict various aspects of yet another embodiment of a production/annulus bore stab with integral flow paths disclosed herein. FIG. 13 is perspective view of this illustrative example of a production/annulus bore stab 100 disclosed herein. FIG. 14 is an enlarged cross-sectional perspective view of the first end 104 of the production/annulus bore stab 100. FIG. 15 is an enlarged cross-sectional perspective view of the second end 106 of the production/annulus bore stab 100. Unless specifically noted otherwise, the above descriptions of various like-number components or features apply equally to this embodiment of the production/annulus bore stab 100.

As before, in this embodiment, the individual and separate flow paths 103 are formed within the body 102. In this example, the production/annulus bore stab 100 comprises a flange 150 at the first (or upper end) 104. As shown in FIG. 16, the flange 150 is adapted to be coupled to another item of equipment 160, such as a valve block of a Christmas tree, etc. Also depicted is a radial gallery (or annulus fluid collection chamber) 151, an annulus fluid inlet/outlet 152, a production seal groove 153 and an annulus seal groove 154. Seals (not shown) will be positioned in the seal grooves 153, 154. Note that, in this example, the first inlet/outlet 103A of each of the individual flow paths 103 intersects the radial gallery 151, while the second inlet/outlet 103B of each of the flow paths 103 are positioned in or extend through the second cylindrical outer surface 102Y of the body 102. The item of equipment 160 also comprises a radial flow gallery 162 that is in fluid communication with the flow paths 103 in the body 102 and with one or more fluid flow paths 166 in the in the item of equipment 160. The internal bore 164 of the item of equipment is also depicted in FIG. 16. The flange 150 may be formed integral with the body 102 or it may be a separate component that that is welded to the remaining portion or the body at, for example, the location of the dashed-line 155 (see FIG. 14). For purposes of the attached claims, either of these configurations should be understood to constitute a one-piece body 102 for the production/annulus bore stab 100.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A production/annulus bore stab, comprising:

a one-piece body comprising a first cylindrical outer surface and a second cylindrical outer surface; and a plurality of individual fluid flow paths defined entirely within the one-piece body, each of the individual fluid flow paths being fluidly isolated from one another within the one-piece body, each of the fluid flow paths comprising a first inlet/outlet at a first end of the fluid flow path and a second inlet/outlet at a second end of the fluid flow path, wherein the first inlet/outlet is positioned in the first cylindrical outer surface and the second inlet/outlet is positioned in the second cylindrical outer surface, wherein at least a portion of the one-piece body is adapted to be positioned within and sealingly coupled to an item of equipment that has at least one fluid flow path formed therein such that the at least one fluid flow path within the item of equipment is in fluid communication with at least one of the plurality of individual fluid flow paths defined within the one-piece body via the first inlet/outlet or the second inlet/outlet.

2. The production/annulus bore stab of claim 1, wherein the one-piece body has an axial length and wherein each of the plurality of individual flow paths extends for substantially the entire axial length of the one-piece body.

3. The production/annulus bore stab of claim 1, wherein the one-piece body has an axial length and a longitudinal center line and wherein each of the plurality of individual flow paths comprises an axial length portion having a centerline that is substantially parallel to the longitudinal centerline.

4. The production/annulus bore stab of claim 3, wherein each of the plurality of individual flow paths comprises a first flow path transition region between the axial length portion and the first inlet/outlet and a second flow path transition region between the axial length portion and the second inlet/outlet.

5. The production/annulus bore stab of claim 3, wherein a line extending through a center of the first inlet/outlet and intersecting the flow path centerline at a first end of the axial length portion defines a first angle that is an obtuse angle.

6. The production/annulus bore stab of claim 5, wherein a line extending through a center of the second inlet/outlet and intersecting the flow path centerline at a second end of the axial length portion defines a second angle that is an obtuse angle.

7. The production/annulus bore stab of claim 3, wherein each of the plurality of individual flow paths comprises first and second radially-oriented flow paths that are in fluid communication with the axial length portion, the first radially-oriented flow path terminating at the first inlet/outlet, the second radially-oriented flow path terminating at the second inlet/outlet, wherein a centerline of each of the first and second radially-oriented openings is positioned substantially normal to the flow path centerline.

8. The production/annulus bore stab of claim 1, wherein each of the plurality of individual flow paths is defined by a plurality of drilled bores in the one-piece body.

9. The production/annulus bore stab of claim 1, wherein the one-piece body comprises an axial length and a longitudinal centerline and wherein each of the plurality of individual flow paths is defined by:

an axial bore that extends for substantially the entire axial length of the one-piece body, the axial bore comprising a centerline that is substantially parallel to the longitudinal centerline;

a first radially-oriented bore that intersects the axial bore, the first inlet/outlet being located adjacent a first end of the first radially-oriented bore; and a second radially-oriented bore that intersects the axial bore, the second inlet/outlet being located adjacent a first end of the second radially-oriented bore.

10. The production/annulus bore stab of claim 1, wherein a diameter of the first cylindrical outer surface is approximately the same as a diameter of the second cylindrical outer surface.

11. The production/annulus bore stab of claim 1, wherein the item of equipment is one of a tubing hanger or a valve block of a production tree.

12. A production/annulus bore stab, comprising:

a one-piece body comprising an outer surface and a flange;

an annulus fluid collection chamber within the flange;

an annulus fluid inlet/outlet in fluid communication with the annulus fluid collection chamber; and a plurality of individual fluid flow paths defined entirely within the one-piece body, each of the individual fluid flow paths being fluidly isolated from one another within at least a portion of the one-piece body, each of the fluid flow paths comprising a first inlet/outlet at a first end of the fluid flow path and a second inlet/outlet at a second end of the fluid flow path, wherein the first inlet/outlet intersects the annulus fluid collection chamber and the second inlet/outlet is positioned in the outer surface, wherein the flange is adapted to be coupled to an item of equipment that has at least one fluid flow path formed therein such that the at least one fluid flow path within the item of equipment is in fluid communication with at least one of the plurality of individual fluid flow paths defined within the one-piece body via the annulus fluid inlet/outlet.

13. The production/annulus bore stab of claim 12, wherein the item of equipment is one of a tubing hanger or a valve block of a production tree.

14. A system, comprising:

an item of equipment comprising at least one fluid flow path formed therein; and a production/annulus bore stab comprising:

a one-piece body comprising a first cylindrical outer surface and a second cylindrical outer surface, wherein at least a portion of the one-piece body is positioned within and sealingly coupled to the item of equipment; and a plurality of individual fluid flow paths defined entirely within the one-piece body, each of the individual fluid flow paths being fluidly isolated from one another within the one-piece body, each of the fluid flow paths comprising a first inlet/outlet at a first end of the fluid flow path and a second inlet/outlet at a second end of the fluid flow path, wherein the first inlet/outlet is positioned in the first cylindrical outer surface and the second inlet/outlet is positioned in the second cylindrical outer surface, wherein the at least one fluid flow path within the item of equipment is in fluid communication with at least one of the plurality of individual fluid flow paths defined within the one-piece body via the first inlet/outlet or the second inlet/outlet.

15. The system of claim 14, wherein the item of equipment is one of a tubing hanger or a valve block of a production tree.

16. A system, comprising:

an item of equipment comprising at least one fluid flow path formed therein; and a production/annulus bore stab comprising:

a one-piece body comprising an outer surface and a flange, wherein the flange is coupled to the item of equipment;

an annulus fluid collection chamber within the flange;

an annulus fluid inlet/outlet in fluid communication with the annulus fluid collection chamber, wherein the annulus fluid inlet/outlet is sealingly coupled to the item of equipment; and a plurality of individual fluid flow paths defined entirely within the one-piece body, each of the individual fluid flow paths being fluidly isolated from one another within at least a portion of the one-piece body, each of the fluid flow paths comprising a first inlet/outlet at a first end of the fluid flow path and a second inlet/outlet at a second end of the fluid flow path, wherein the first inlet/outlet intersects the annulus fluid collection chamber and the second inlet/outlet is positioned in the outer surface, wherein the annulus fluid inlet/outlet is sealingly coupled to the item of equipment such that the at least one fluid flow path within the item of equipment is in fluid communication with at least one of the plurality of individual fluid flow paths defined within the one-piece body.

17. The system of claim 16, wherein the item of equipment is one of a tubing hanger or a valve block of a production tree.

* * * * *